US011178497B2

(12) United States Patent
Bottoni et al.

(10) Patent No.: US 11,178,497 B2
(45) Date of Patent: Nov. 16, 2021

(54) IN-EAR RECEIVER

(71) Applicant: USound GmbH, Graz (AT)

(72) Inventors: Ferruccio Bottoni, Graz (AT); Andrea Rusconi Clerici Beltrami, Vienna (AT)

(73) Assignee: USound GmbH, Graz (AT)

( * ) Notice: Subject to any disclaimer, the term of this patent is extended or adjusted under 35 U.S.C. 154(b) by 0 days.

(21) Appl. No.: 16/624,552

(22) PCT Filed: Jun. 14, 2018

(86) PCT No.: PCT/EP2018/065749
§ 371 (c)(1),
(2) Date: Dec. 19, 2019

(87) PCT Pub. No.: WO2018/234132
PCT Pub. Date: Dec. 27, 2018

(65) Prior Publication Data

US 2020/0221238 A1 Jul. 9, 2020

(30) Foreign Application Priority Data

Jun. 23, 2017 (DE) ..... 102017114008.5

(51) Int. Cl.
*H04R 25/00* (2006.01)
*H04R 1/10* (2006.01)
(Continued)

(52) U.S. Cl.
CPC ..... *H04R 25/652* (2013.01); *H04R 1/1016* (2013.01); *H04R 1/1058* (2013.01);
(Continued)

(58) Field of Classification Search
CPC .. H04R 25/656; H04R 1/1016; H04R 1/1058; H04R 1/2811; H04R 11/14;
(Continued)

(56) References Cited

U.S. PATENT DOCUMENTS 4,449,019 A 5/1984 Kakehi et al.
8,218,803 B2 7/2012 Fickweiler et al.
(Continued)

FOREIGN PATENT DOCUMENTS

AT 371661 7/1983
CN 101389157 A 3/2009
(Continued)

OTHER PUBLICATIONS

German Search Report, DE Application No. 102017114008.5, dated Mar. 12, 2018, 20 pages.
(Continued)

*Primary Examiner* — Sean H Nguyen
(74) *Attorney, Agent, or Firm* — Dority & Manning, P.A.

(57) ABSTRACT

An in-ear receiver can be used in a headset and/or hearing aid and includes a housing in which at least one ear canal section is configured to be inserted into an ear canal of a wearer when the in-ear receiver is used as intended. The housing defines at least one outer contour that is configured with at least in one section adapted to the ear canal of the wearer. The in-ear receiver includes a sound transducer arranged in the housing, and at least one resonant cavity, which is formed in the housing and is divided by the sound transducer into a front volume and a rear volume. The sound transducer is a MEMS sound transducer, and the front volume and/or the rear volume have/has an inner contour adapted to the ear canal.

14 Claims, 5 Drawing Sheets

(51) Int. Cl.
*H04R 1/28* (2006.01)
*H04R 11/14* (2006.01)

(52) U.S. Cl.
CPC ..... *H04R 1/2811* (2013.01); *H04R 11/14* (2013.01); *H04R 25/604* (2013.01); *H04R 25/656* (2013.01); *H04R 25/658* (2013.01); *H04R 2201/003* (2013.01); *H04R 2201/029* (2013.01)

(58) Field of Classification Search
CPC ..... H04R 25/604; H04R 25/658; H04R 2201/003; H04R 2201/029
USPC ..... 381/312
See application file for complete search history.

(56) References Cited

U.S. PATENT DOCUMENTS

| | | | |
|---|---|---|---|
| 8,638,964 | B2 | 1/2014 | Vaarbroe et al. |
| 9,351,086 | B2 | 5/2016 | Petersen et al. |
| 9,654,856 | B1 * | 5/2017 | Horbach ..... H04R 7/127 |
| 10,412,505 | B2 | 9/2019 | Rusconi Beltrami et al. |
| 2011/0188687 | A1 | 8/2011 | Sonn et al. |
| 2012/0243717 | A1 | 9/2012 | Lim et al. |
| 2015/0334492 | A1 | 11/2015 | Burns et al. |
| 2016/0066081 | A1 | 3/2016 | Annunziato et al. |
| 2016/0157027 | A1 | 6/2016 | Hug et al. |
| 2017/0099553 | A1 | 4/2017 | Sacha et al. |

FOREIGN PATENT DOCUMENTS

| | | | |
|---|---|---|---|
| CN | 102177733 | A | 9/2011 |
| CN | 104427454 | A | 3/2015 |
| CN | 105556989 | A | 5/2016 |
| DE | 4233651 | | 4/1994 |
| DE | 102015107560 | | 11/2016 |
| EP | 3013069 | | 4/2016 |
| GB | 2101521 | | 5/1985 |
| JP | S60127092 | | 7/1985 |
| JP | 2016119527 | | 6/2016 |

OTHER PUBLICATIONS

International Search Report, PCT Application No. PCT/EP2018/065749, dated Sep. 13, 2018, pages.
Chinese Office Action dated Jan. 27, 2021, 11 pages.

* cited by examiner

IN-EAR RECEIVER

CROSS REFERENCE TO RELATED APPLICATIONS

Not Applicable

FIELD OF THE INVENTION

The present invention relates to an in-ear receiver, in particular a headset and/or hearing aid, comprising a housing, which includes at least one ear canal section, which is inserted into an ear canal of a wearer when the in-ear receiver is used as intended, and at least one outer contour adapted at least in one section to the ear canal, a sound transducer arranged in the housing, and at least one resonant cavity, which is formed in the housing and is divided by the sound transducer into a front volume and a rear volume.

BACKGROUND OF THE INVENTION

US 2016/0066081 A1, which is hereby incorporated herein by this reference for all purposes, describes an ear receiver comprising a housing in which a resonant cavity is formed. A sound transducer of the ear receiver subdivides the resonant cavity into a front volume and a rear volume. The ear receiver also includes an ear canal section, which is inserted into an ear canal of a wearer when the ear receiver is used as intended. The disadvantage of this ear receiver is that, due to the shape of the sound transducer, a geometry of the resonant cavity is predefined and is changeable only in a highly limited way.

OBJECTS AND SUMMARY OF THE INVENTION

The object of the present invention is therefore to create an in-ear receiver, with the aid of which the disadvantages of the related art are eliminated.

The object is achieved by means of an in-ear receiver having the features described below.

The invention describes an in-ear receiver comprising a housing. The in-ear receiver can be, for example, a headset, which can be coupled to a music player or a communication device, for example, a smartphone, in order to be able to listen to music or speech. Additionally or alternatively, the in-ear receiver can also be a hearing aid, in order to amplify tones and sounds in the case of a hearing impairment.

The housing comprises an ear canal section, which is inserted into an ear canal of a wearer when the in-ear receiver is used as intended. Due to the fact that the ear canal section is arranged in the ear canal, the tones, the music, or the speech can be conducted directly into the ear. In this way, on the one hand, the performance of the in-ear receiver can be reduced, since the tones, the music, or the speech are/is conducted directly to the ear. On the other hand, tones, music, or speech escape to the outside to a lesser extent, and so a disturbance for other persons is reduced.

Furthermore, the housing has an outer contour adapted at least in one section to the ear canal. As a result, a wearing comfort of the in-ear receiver is improved. Furthermore, as a result, the entire available inner volume of the ear canal can be utilized for designing the housing. The outer contour preferably has a freeform geometry and/or an organic ear-canal shape. The freeform geometry preferably corresponds to the individual shape of the, in particular outer, ear canal of the particular user. This is preferably measured and/or produced with the aid of a 3D printing process.

Moreover, the in-ear receiver comprises a sound transducer arranged in the housing. The sound transducer can be operated as a loudspeaker, so that the tones, the music, or the speech can be output with the aid of this loudspeaker.

In addition, a resonant cavity is formed in the housing, which is divided by the sound transducer into a front volume and a rear volume. With the aid of the resonant cavity, the sound waves generated by the sound transducer can be amplified and/or modified with respect to their spectrum.

The sound transducer is a MEMS sound transducer. The abbreviation MEMS stands for micro-electromechanical systems. The MEMS sound transducer can be designed in more complex shapes than, for example, an electrodynamic sound transducer or a balanced-armature sound transducer, and so nearly no limits are placed on a shape of the resonant cavity or of the front and/or the rear volume by the MEMS sound transducer. As a result, the shape of the front volume and/or of the rear volume can be adapted in such a way that an optimal resonance effect or amplification and frequency modification is/are achievable.

Moreover, at least the front volume has an inner contour adapted to the ear canal and/or the corresponding outer contour. Additionally or alternatively, the rear volume also has an inner contour adapted to the ear canal and/or the corresponding outer contour. Due to the adapted inner contour, the resonant cavity in the respective volumes is designed to be as large as possible, in order to amplify the sound waves generated by the sound transducer as well as possible. The front volume can be adapted to the inner contour of the ear canal partially, in particular in one or multiple sections, or completely, i.e., in particular along its entire length. Alternatively or additionally, the rear volume can be adapted to the inner contour of the ear canal partially, in particular in one or multiple sections, or completely, i.e., in particular along its entire length. The inner contour of the front volume and/or the inner contour of the rear volume preferably have/has a freeform geometry. It is also advantageous when the outer contour of the housing has, in the area of the front volume and/or the rear volume, a freeform geometry corresponding to the inner contour.

In an advantageous enhanced embodiment of the invention, only the inner contour of the front volume and the outer contour corresponding thereto can have a shape adapted to the ear canal, in particular a freeform geometry. The rear volume and the outer contour of the housing corresponding thereto are not adapted to the shape of the ear canal and/or arranged outside the ear canal, in particular in the area of the auricle, when the in-ear receiver is used as intended.

It is advantageous when the housing is made, at least in the area of the front volume, of a material that is deformable in the presence of body heat, so that the housing automatically adapts to the organic freeform geometry of an ear canal, within a time window, after having been inserted into the ear canal.

Due to the adaptation of the front and/or the rear volume to the ear canal, the front and/or the rear volume advantageously have/has resonance properties similar to those of the ear canal. In this way, with the aid of the sound transducer and the resonant cavity, a natural sound pattern (i.e., as if there were no in-ear receiver in the ear) can be generated. In particular in the case of 3D audio applications, a simplified outer ear transmission function can therefore be utilized, in particular one that only takes the auricle shape, and not the ear canal shape, into account, since the actual shape of the ear canal is essentially reproduced by the inner contour of the front volume and/or the rear volume.

In an advantageous enhanced embodiment of the invention, the inner contour is essentially a negative shape of the outer contour. This means, in the case of areas of the outer contour that have, for example, a concave shape, the associated areas of the inner contour are designed to be convex. Areas of the outer contour that have a convex shape, however, have corresponding areas of the inner contour that are designed to be concave. As a result, the inner contour can be adapted to the ear canal in an easy way.

It is also advantageous when the housing is produced in a 3D printing process. The housing can be formed quickly with the aid of the 3D printing process. In addition, the housing can be adapted to the various shapes of the ear canals of various wearers. Additionally or alternatively, the housing can also be produced in an injection molding process. A large quantity can be cost-effectively produced with the aid of the injection molding process.

Additionally or alternatively, for example, the ear canal section may also be produced with the aid of the 3D printing process, since only this portion of the housing is arranged in the ear canal. The portion of the housing arranged outside the ear canal may be formed with the aid of the injection molding process. As a result, the ear canal section may be adapted to the anatomy of the ear canal of the wearer, whereas the remaining portion of the housing may be formed in a low-cost manner.

Moreover, it is advantageous when the housing is rigidly designed. It is also possible that only the ear canal section is rigidly designed. The rigid housing therefore retains its shape, and so the outer contour adapted to the ear canal is retained.

For this purpose, the housing and/or the ear canal section can be made, for example, of a plastic, such as a thermoplastic and/or a thermosetting plastic. Additionally or alternatively, the housing and/or the ear canal section can also be made of an elastomer.

It is advantageous when a housing wall delimiting the front volume has a uniform thickness. Additionally or alternatively, the housing wall delimiting the rear volume can also have a uniform thickness. As a result, the front and/or the rear volume can be designed, in an easy way, to be as large as possible, in order to improve the amplifying effect of the respective resonant cavities.

Moreover, it is advantageous when the front volume is arranged in the ear canal section. Additionally or alternatively, the rear volume can also be arranged in the ear canal section. Moreover, additionally or alternatively, the MEMS sound transducer can also be arranged in the ear canal section. As a result, the tone, the music, and/or the speech can be generated directly in the ear canal, and so, for example, a noise nuisance for persons in the surroundings is also reduced.

It is also advantageous when the MEMS sound transducer is arranged perpendicularly to a longitudinal direction of the housing. As a result, the sound waves generated by the sound transducer can be radiated directly into the front volume and/or the rear volume.

It is also advantageous when the housing wall has thickened portions and/or thinned portions in the front volume, at least in some areas. Additionally or alternatively, the housing wall can also have thickened portions and/or thinned portions in the rear volume, at least in some areas. As a result, the resonant cavity can be enlarged and/or reduced, at least in some areas, in the front and/or the rear volume. As a result, the resonance properties of the front and/or the rear volume can be adapted.

It is also advantageous when at least one resonant element is arranged in the housing. The resonance properties of the resonant cavity can also be adapted with the aid of the resonant elements. The resonant element can be arranged, for example, in the front volume for this purpose. Additionally or alternatively, the resonant element can also be arranged in the rear volume. Preferably, the resonant element and the housing are made of materials that are different from one another. Preferably, the resonant element is made of a porous material. As a result, the surface can be enlarged.

Moreover, it is advantageous when an edge region of the MEMS sound transducer is at least partially set into the housing wall. As a result, the MEMS sound transducer is fixedly connected to the housing.

It is advantageous when the ear canal section comprises a sound outlet in the area of a first end arranged in the ear canal. The sound outlet faces the tympanic membrane of the wearer when the in-ear receiver is used as intended. As a result, the sound waves generated by the sound transducer can be conducted directly to the tympanic membrane.

It is advantageous when the in-ear receiver comprises operating means for operating the in-ear receiver in the area of a second end positioned opposite the first end. The operating means can include, for example, an energy unit for the energy supply of the in-ear receiver, a memory unit for storing tones and/or music, a control unit for playing back the tones and/or music, and/or a data transmission unit for transmitting data between an external unit and the in-ear receiver. The data transmission unit can include, for example, a Bluetooth interface and/or a W-LAN interface. Due to the operating means on the in-ear receiver, the in-ear receiver can be self-sufficiently operated.

It is advantageous when an interface for the operating means of the in-ear receiver is arranged in the region of the second end. The interface can be, for example, a jack socket, a W-LAN interface, and/or a Bluetooth interface. With the aid of the interface, the operating means for the in-ear receiver can be arranged, for example, in a unit, which can be worn behind the ear, in particular the auricle. An audio signal, which includes the music, the tones, and/or the speech, and/or the energy for operating the in-ear receiver can be conducted via the interface to the sound transducer. In addition, a connection to a smartphone can also be established with the aid of the interface, so that the music, etc., can be played back from the smartphone. As a result, the in-ear receiver can be designed to be more compact.

It is also advantageous when an audio line extending between the interface, the operating means, and/or the MEMS sound transducer is embedded into the housing wall. The audio line can also be embedded into the housing. Advantageously, the audio line can be overprinted within the scope of the injection molding process and/or the 3D printing process. As a result, the audio line is disposed neither in the resonant cavity, where it would negatively affect the resonance properties, nor outside the housing, where it would worsen the wearing comfort.

BRIEF DESCRIPTION OF THE DRAWINGS

Further advantages of the invention are described in the following exemplary embodiments. Wherein.

DETAILED DESCRIPTION OF EXEMPLARY EMBODIMENTS

Figure 1:
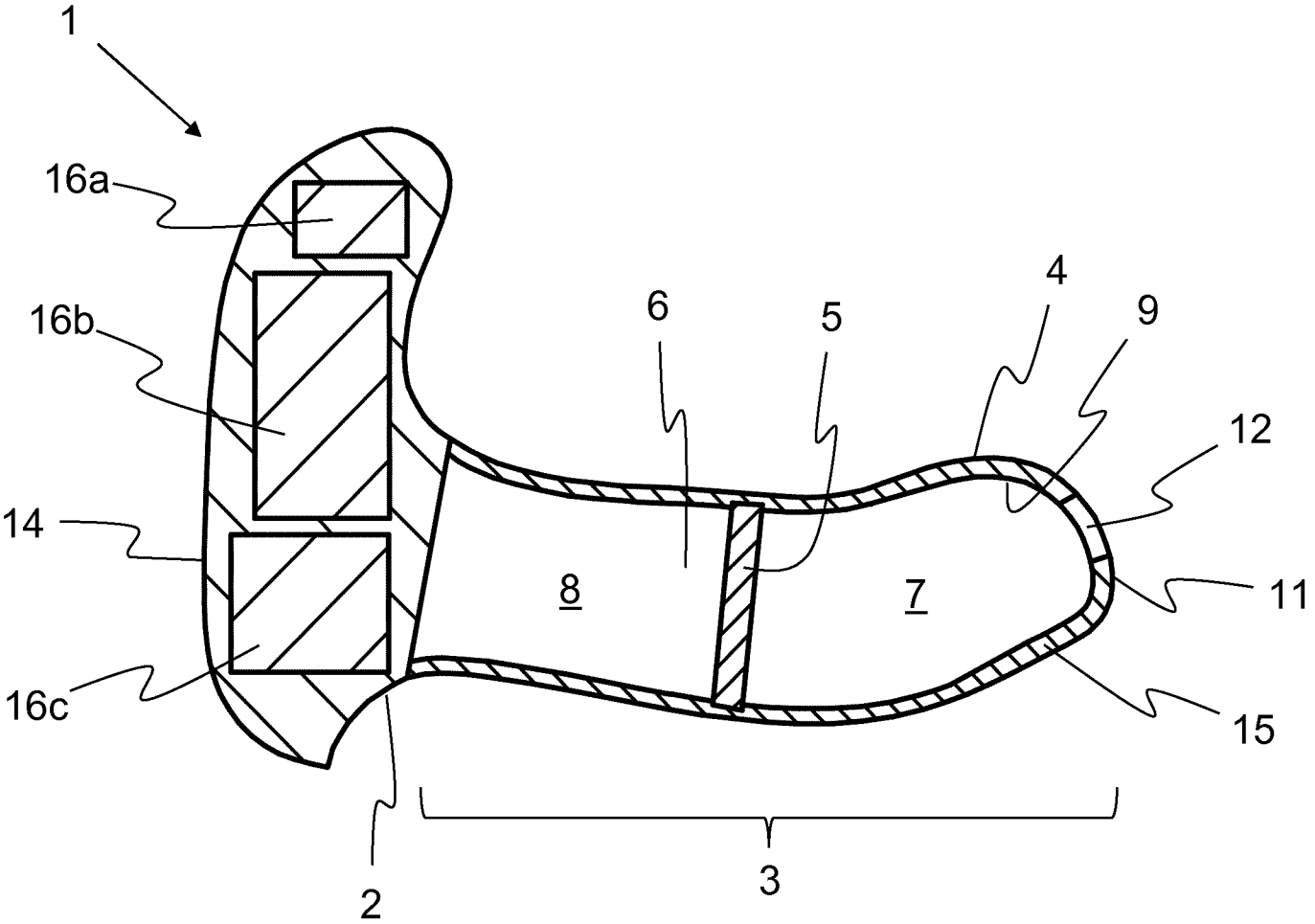
FIG. 1 shows a sectional view of an in-ear receiver comprising a housing and a sound transducer arranged therein.
Figure 2:
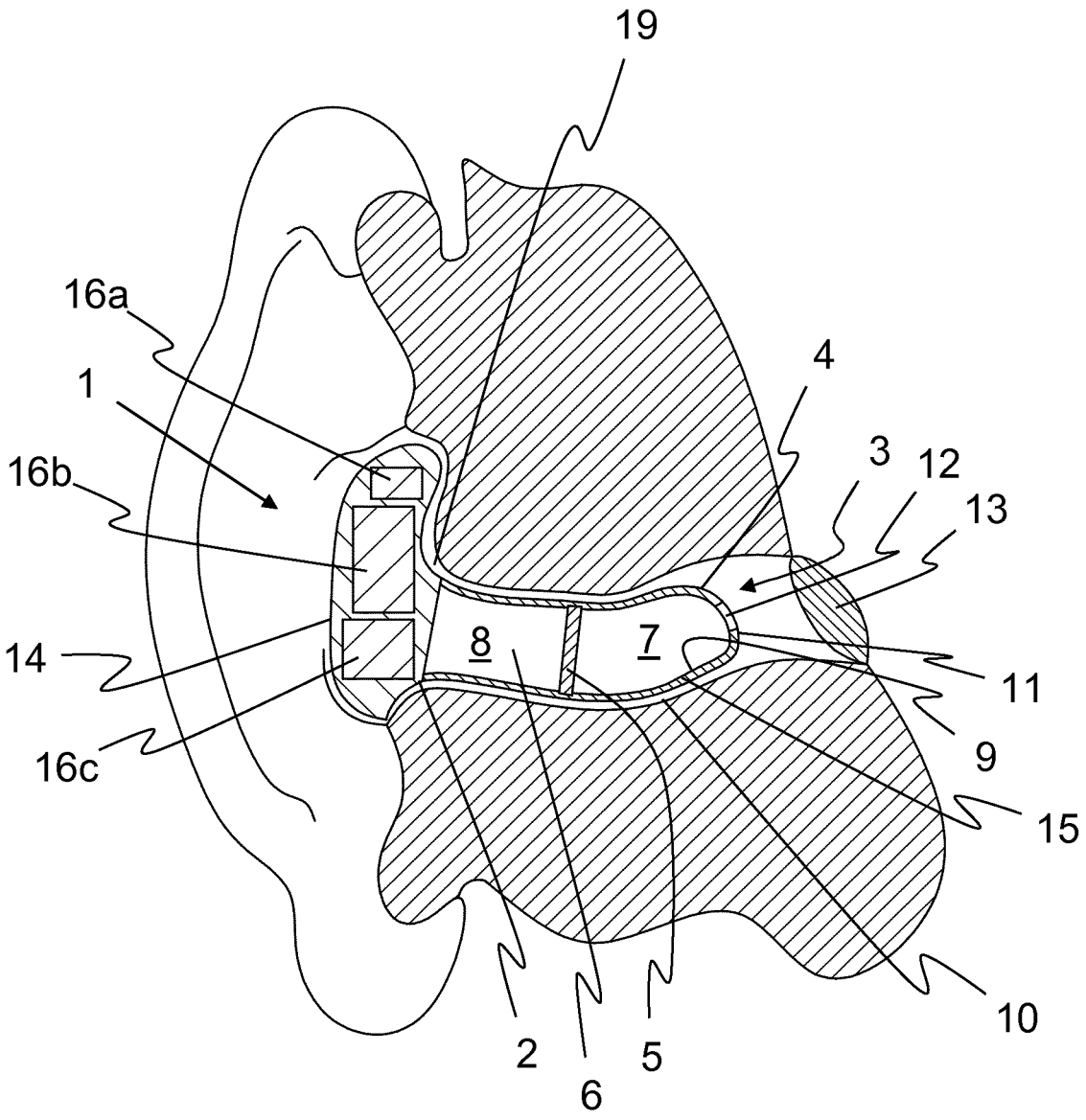
FIG. 2 shows a sectional view of the in-ear receiver according to FIG. 1, wherein an ear canal section is arranged in the ear canal of a wearer.

FIG. 1 shows a sectional view of an in-ear receiver 1 comprising a housing 2. The in-ear receiver 1 arranged in an ear canal is shown in FIG. 2. The essential features of the in-ear receiver 1 are the same in the two FIGS. 1 and 2, and so reference is made to both FIGS. 1 and 2 in order to describe the features and their functions.

The in-ear receiver 1 can be, for example, a hearing aid, which is utilized for hearing assistance. The in-ear receiver 1 can also be a headset, however, so that, for example, music can be listened to with the aid thereof. The in-ear receiver 1 can also be utilized for communication, however, in order to conduct speech directly into the ear, for example, during a telephone call.

The housing 2 comprises at least one ear canal section 3, which is inserted into the ear canal 10 of a wearer when the in-ear receiver 1 is used as intended. Moreover, the housing 2 has an outer contour section 4, which is adapted to the ear canal 10 for high wearing comfort.

The in-ear receiver 1 comprises a sound transducer 5 in the housing 2 in order to generate sound waves. For example, the tones, music, and/or speech can be generated with the aid of the sound transducer 5.

Moreover, a resonant cavity 6 is arranged in the housing 2. In addition, the sound transducer 5 divides the resonant cavity 6 into a front volume 7 and a rear volume 8. The sound waves generated by the sound transducer 5 can be amplified with the aid of the resonant cavity 6. Additionally or alternatively, the sound waves can also be modified with the aid of the resonant cavity 6. The amplification and/or the modification can depend on the shape and/or the geometry of the resonant cavity 6.

According to the invention, the sound transducer 5 is a MEMS sound transducer. The MEMS sound transducer has an advantage, namely that it is simply designed. In addition, the MEMS sound transducer is not dependent on a special shape factor, i.e., the shape of the sound transducer 5 or geometry. Rather, the MEMS sound transducer can be relatively easily designed in various shapes. For example, the MEMS sound transducer can be designed to have a round, oval, elliptical, and/or angular cross section. With respect to the sound transducers known from the related art, in fact, the housing 2 and also the resonant cavity 6 must be adapted to the predefined shape of the sound transducer 5. With the aid of the MEMS sound transducer 5, first of all, the resonant cavity 6 can be adapted in such a way that its resonance properties are optimized. Thereupon, the MEMS sound transducer 5 can be designed according to the geometric requirements of the resonant cavity 6 or of the housing 2.

Additionally, according to the invention, the front volume 7 has an inner contour section 9 adapted to the ear canal 10. Additionally or alternatively, the inner contour section 9 of the rear volume 8 can also be adapted to the ear canal 10. As a result, for example, the resonance properties of the front volume 7 and/or the rear volume 8 are adapted to the resonance properties of the ear canal 10. As a result, a sound pattern is imparted, which is essentially similar to that of the ear canal 10 without the in-ear receiver 1. The tones, music, and/or speech are amplified, modified, and/or relayed in such a way as if an in-ear receiver 1 were not arranged in the ear canal 10. The inner contour section 9 of the front volume 7 and/or the rear volume 8, which has been adapted to the ear canal 10, therefore results in an essentially unchanged and natural sound.

In the present exemplary embodiment, the housing 2 further comprises, on a first end 11 arranged in the ear canal 10, an exit opening 12, which faces a tympanic membrane 13 of the wearer when the in-ear receiver 1 is used as intended, according to FIG. 2. As a result, the sound waves exiting through the exit opening 12 can directly reach the tympanic membrane 13.

As shown in the present exemplary embodiment, the sound transducer 5 can be arranged essentially in parallel to the cross section of the housing 2 and/or to the cross section of the ear canal section 3. As a result, the sound transducer 5 divides the resonant cavity 6 into the front volume 7 and into the rear volume 8. In addition, as a result, the sound waves generated by the sound transducer 5 are radiated in the direction of the exit opening 12.

Moreover, the inner contour section 9 can be, for example, a negative shape of the outer contour section 4, as shown in the present exemplary embodiment. This means, for example, the inner contour section 9 is designed to be concave in areas in which the outer contour section 4 is designed to be convex, such as in the area of the first end 11. By comparison, when the outer contour section 4 is designed to be concave, the associated area of the inner contour section 9 is designed to be convex. As a result, the inner contour section 9 can be adapted to the ear canal 10 in an easy way.

Moreover, it is advantageous when a housing wall 15 of the housing 2 has a uniform thickness. As a result, the inner contour section 9 can also be adapted to the ear canal 10 in an easy way.

Operating means 16*a-c* are arranged on a second end 14 of the housing 2 positioned opposite the first end 11, as shown in the present exemplary embodiment. In the exemplary embodiment shown in FIGS. 1-5, the operating means 16*a-c* are represented merely by way of example. The in-ear receiver 1 can also comprise more than three operating means 16*a-c*. Alternatively, the operating means 16*a-c* can also be arranged in a single unit. The operating means 16*a-c* can encompass, for example, an energy storage unit for the energy supply of the in-ear receiver 1, a memory unit for storing music, tones, and/or sounds, a control unit for controlling the in-ear receiver 1, and/or a data transmission unit for transmitting data between an external unit and the in-ear receiver 1. The data transmission unit can include, for example, a Bluetooth interface and/or a W-LAN interface. As a result, the in-ear receiver 1 can be self-sufficiently operated.

Additionally or alternatively, an interface (not shown here) can also be arranged on the second end 14. The interface can be, for example, a jack socket, with the aid of which an audio signal can be conducted to the in-ear receiver 1. As a result, the in-ear receiver 1 can be operated, for example, by an external unit worn behind the ear. The in-ear receiver 1 can be designed to be more compact as a result.

A connection between a smartphone and the in-ear receiver 1 can also be established, however, with the aid of the interface. The interface can also be the Bluetooth interface, however.

The section of the in-ear receiver 1 in the area of the second end 14 is designed to be enlarged as compared to the section of the in-ear receiver 1 in the area of the first end 11 or in the area of the ear canal section 3. In particular, the section in the area of the second end 14 is adapted to an inner contour of the auricle, so that the in-ear receiver 1 can be comfortably worn. The enlarged or thickened portion of the in-ear receiver 1 in the area of the second end 14 can at least partially cover an ear canal inlet 19. As a result, penetration by disturbing noises from outside the ear can be reduced. Additionally or alternatively, the sound waves generated by the sound transducer 5 can be limited to the ear canal 10. As a result, fewer sound waves escape to the outside, and so a disturbance of the surroundings can be reduced.

It is advantageous for the invention when the housing 2 is produced in a 3D printing process. Additionally or alternatively, the housing 2 can also be produced in an injection molding process. The 3D printing process has, inter alia, the advantage that the housing 2 can be quickly produced with the aid of the 3D printing process. In addition, in particular, the ear canal section 3 can be individually adapted to the ear canals 10 of various wearers with the aid of the 3D printing process. In addition, the front volume 7 and/or the rear volume 8 can be adapted to special resonance properties with the aid of the 3D printing process.

By comparison, the housings 2 can be produced in large quantities at low cost with the aid of the injection molding process.

It is also advantageous when, for example, the ear canal section 3 is produced with the aid of the 3D printing process and the rest of the housing 2, in particular the area on the second end 14 in which the operating means 16*a-c* and/or the interface are/is arranged, is produced with the aid of the injection molding process. As a result, the ear canal section 3 can be adapted to the individual ear canal 10 of every wearer, whereas the rest of the housing 2 is produced at low cost.

Figure 3:
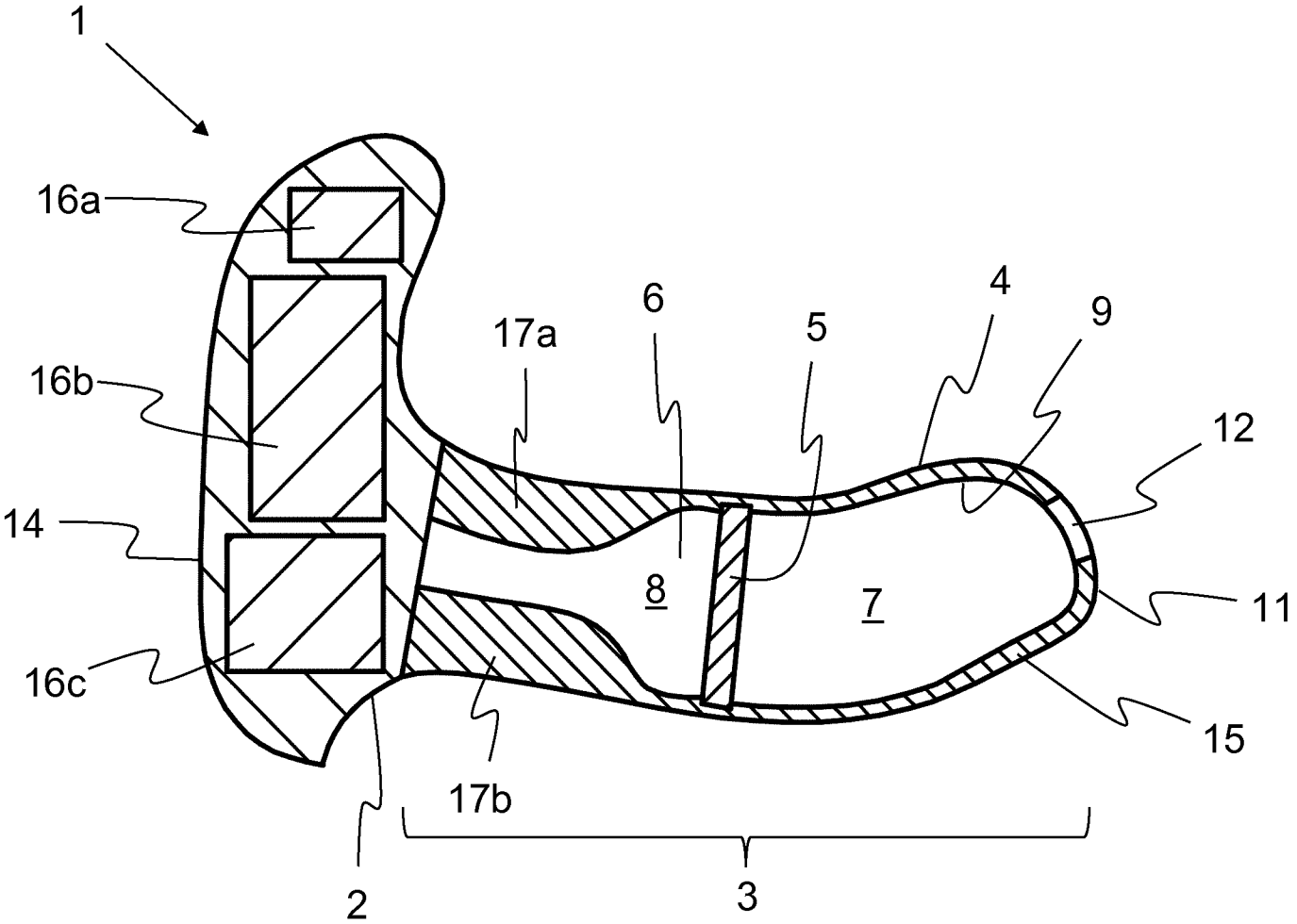
FIG. 3 shows a sectional view of an in-ear receiver comprising thickened portions of the housing wall arranged in the resonant cavity.

FIG. 3 shows a sectional view of an alternative exemplary embodiment of an in-ear receiver 1 comprising at least one thickened portion 17*a*, 17*b* arranged in the resonant cavity 6. Two thickened portions 17*a*, 17*b* are arranged in this exemplary embodiment. Furthermore, in the present exemplary embodiment, the thickened portions 17*a*, 17*b* are arranged in the rear volume 8. The thickened portions 17*a*, 17*b* thicken the housing wall 15 in their regions. Additionally or alternatively, the thickened portions 17*a*, 17*b* can also be arranged in the front volume 7. Moreover, additionally or alternatively, at least one thinned portion can be arranged in the resonant cavity 6, in particular in the front volume 7 and/or in the rear volume 8. The thinned portion thins the housing wall 15 in the region in which the thinned portion is formed.

The resonance properties of the resonant cavity 6 and, in particular, of the front volume 7 and/or of the rear volume 8 can be adapted with the aid of the thickened portions 17*a*, 17*b* and/or the thinned portions (not shown here).

Figure 4:
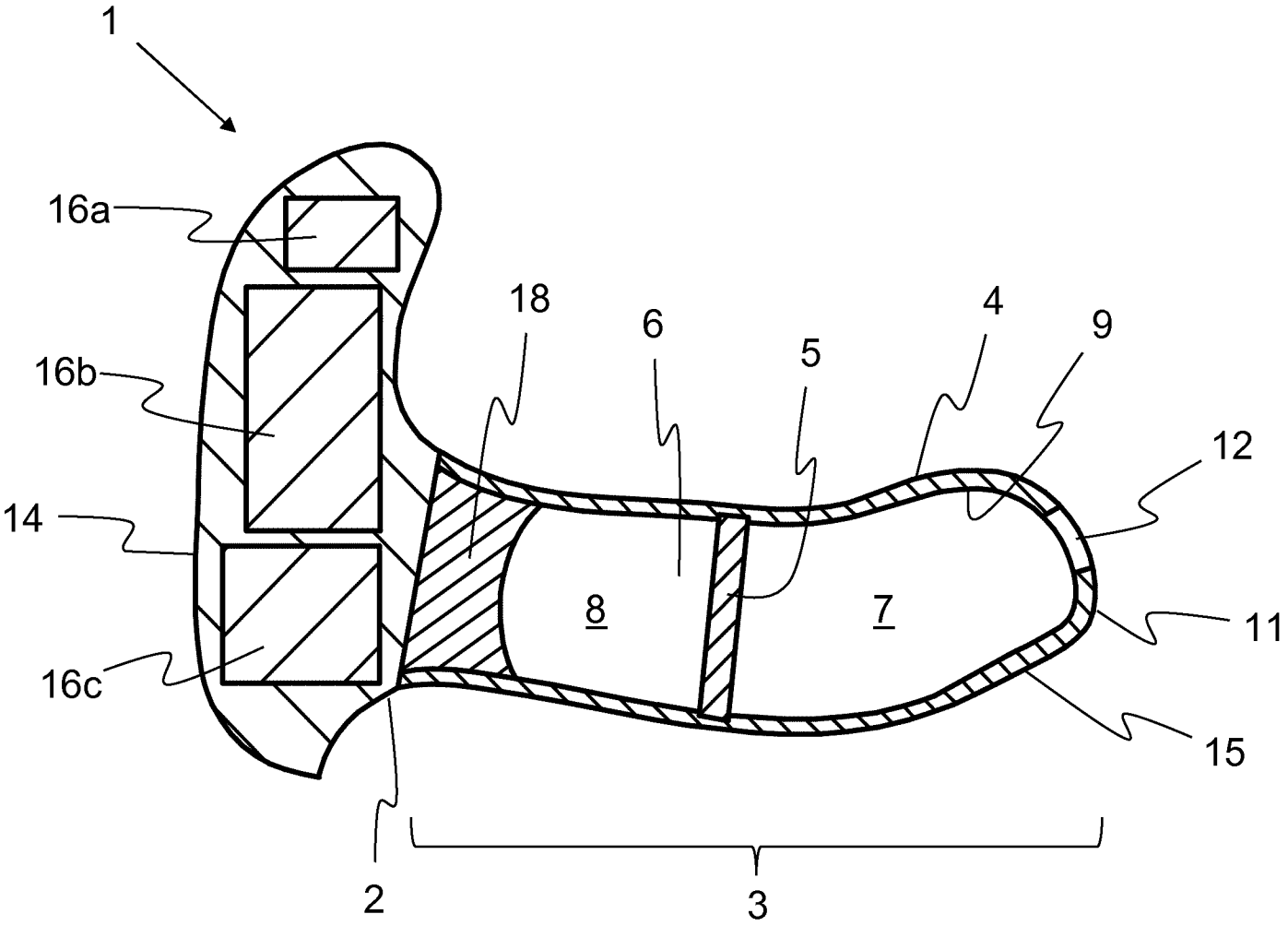
FIG. 4 shows a sectional view of an in-ear receiver comprising a resonant element arranged in the resonant cavity.

FIG. 4 shows a further alternative exemplary embodiment of an in-ear receiver 1. In the present exemplary embodiment, a resonant element 18 is arranged in the resonant cavity 6. The resonant element 18 is arranged in the rear volume 8 in this case. Additionally or alternatively, the resonant element 18 can also be arranged in the front volume 7. The resonance properties of the resonant cavity 6, in particular of the front volume 7 and/or the rear volume 8, can also be adapted with the aid of the resonant element 18.

Figure 5:
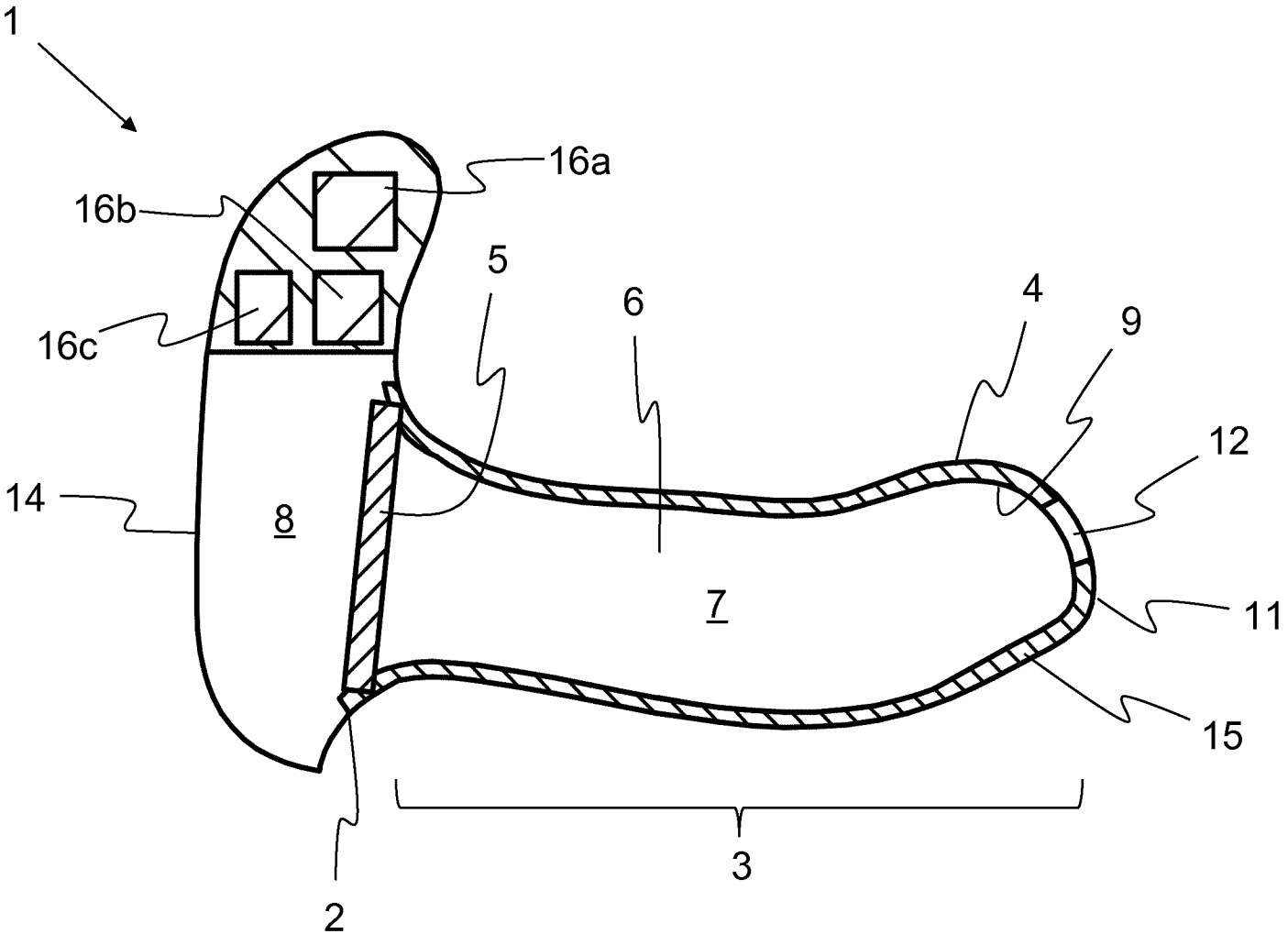
FIG. 5 shows a sectional view of an in-ear receiver comprising a sound transducer in the area of a second end of the in-ear receiver.

FIG. 5 shows a sectional view of an exemplary embodiment of an in-ear receiver 1, wherein the sound transducer 5 is arranged in the area of the second end 14. The sound transducer 5 is arranged on the end of the ear canal section 3 positioned opposite the sound outlet 12 or the first end 11. The ear canal section 3 therefore begins at the sound transducer 5 and extends up to the sound outlet 12 or to the first end 11. The ear canal section 3 extends between the sound transducer 5 and the first end 11 or the sound outlet 12. When the in-ear receiver 1 is used as intended, the sound transducer 5 is arranged in the area of the ear canal inlet 19 and/or the auricle. Since the section of the in-ear receiver 1 is enlarged in the area of the second end 14, the sound transducer 5 can be designed to be larger, which provides advantages in the production of the in-ear receiver 1. According to the present exemplary embodiment, the sound transducer 5 divides the resonant cavity 6 into the rear volume 8 and the front volume 7. Due to the enlarged section of the in-ear receiver 1 in the area of the second end 14, the rear volume 8 and/or a loudspeaker-side end section of the front volume 7 are/is also enlarged. As a result, good acoustics can be achieved. Additionally or alternatively, resonant elements 18 (not shown here) can be arranged in the rear volume 8 and/or in the front volume 7.

The housing wall 15, which, according to FIG. 5, extends only in the region of the ear canal section 3, can, additionally or alternatively, also extend in the section of the in-ear receiver 1 in the region of the second end 14. According to the present exemplary embodiment, the housing wall 15 can also extend in the region of the rear volume 8.

In the exemplary embodiments represented in FIGS. 1, 2, 3, 4, and 5, the inner contour section 9 of the front volume 7 has a freeform geometry and/or an organic ear canal geometry adapted to the inner contour of the ear canal. In the exemplary embodiments represented in FIGS. 1, 2, and 4, this also relates to the inner contour section 9 of the rear volume 8. The inner contour section 9 of the rear volume is not adapted, at least in some areas, to the inner contour of the ear canal or to the outer contour of the housing only in the exemplary embodiment represented in FIGS. 3 and 5. The freeform geometry is modeled after the organic shape of the outer ear canal in all cases.

The present invention is not limited to the represented and described exemplary embodiments. Modifications within the scope of the claims are also possible, as is any combination of the features, even if they are represented and described in different exemplary embodiments.

LIST OF REFERENCE CHARACTERS

1 in-ear receiver
2 housing
3 ear channel section
4 outer contour section
5 sound transducer
6 resonant cavity
7 front volume
8 rear volume
9 inner contour section
10 ear canal
11 first end
12 exit opening
13 tympanic membrane
14 second end
15 housing wall

16 operating means
17 thickened portions
18 resonant element
19 ear canal inlet

The invention claimed is:

1. An in-ear receiver for a headset and/or hearing aid that fits at least partially into an ear canal of a wearer when the in-ear receiver is used as intended, the in-ear receiver comprising:

a housing that includes an ear canal section, which is configured to be inserted into the ear canal of the wearer when the in-ear receiver is used as intended;

a resonant cavity, which is formed in the ear canal section and includes a front volume and a rear volume that is physically separated from the front volume by a physical separation that separates the front volume from the rear volume;

an inner contour section of the ear canal section faces inwardly toward the front volume and inwardly toward the rear volume, wherein the inner contour section of the ear canal section defines the front volume and the rear volume;

an outer contour section of the ear canal section faces away from the front volume and faces away from the rear volume, wherein the outer contour section of the ear canal section faces toward the ear canal of the wearer when the in-ear receiver is used as intended;

a MEMS sound transducer that is disposed in the resonant cavity and that forms the physical separation between the front volume and the rear volume of the resonant cavity; and wherein with the exception of the MEMS sound transducer, the resonant cavity is devoid of structure depending from the inner contour section of the ear canal.

2. The in-ear receiver as claimed in claim 1, wherein the inner contour is essentially a negative shape of the outer contour section.

3. The in-ear receiver as claimed in claim 1, wherein the housing is produced in a 3D printing process and/or an injection molding process.

4. The in-ear receiver as claimed in claim 1, wherein the ear canal section is rigidly designed.

5. The in-ear receiver as claimed in claim 1, the inner contour section that is delimiting the front volume and/or the rear volume and has a uniform thickness.

6. The in-ear receiver as claimed in claim 5, wherein the inner contour section comprises relatively thickened portions and relatively thinned portions in the front volume and/or rear volume.

7. The in-ear receiver as claimed in claim 5, wherein the MEMS sound transducer includes an edge region that is at least partially set into the inner contour section.

8. The in-ear receiver as claimed in claim 1, further comprising a resonant element arranged in the housing and made of a different material as compared to the housing.

9. The in-ear receiver as claimed in claim 1, wherein the ear canal section comprises a sound outlet defined in a first end.

10. The in-ear receiver as claimed in claim 9, further comprising operating means configured for operating the in-ear receiver, the operating means being disposed in a second end, which is positioned opposite the first end.

11. The in-ear receiver as claimed in claim 10, further comprising an interface arranged in a region of the second end.

12. The in-ear receiver as claimed in claim 11, further comprising an audio line extending between the interface, the operating means, and/or the MEMS sound transducer, wherein the audio line is embedded into the housing.

13. The in-ear receiver as claimed in claim 11, further comprising an audio line extending between the interface, the operating means, and/or the MEMS sound transducer, wherein the audio line is embedded into the housing.

14. The in-ear receiver as claimed in claim 1, wherein each of the inner contour section and the outer contour section is composed of material that is deformable in the presence of body heat of the ear canal to automatically conform to an organic freeform geometry of the ear canal upon insertion into the ear canal.

* * * * *